United States Patent [19]

Brander

[11] Patent Number: 4,735,973

[45] Date of Patent: Apr. 5, 1988

[54] ADDITIVE FOR SAND BASED MOLDING AGGREGATES

[76] Inventor: John J. Brander, 2973 S. Delaware St., Milwaukee, Wis. 53207

[21] Appl. No.: 798,556

[22] Filed: Nov. 15, 1985

[51] Int. Cl.[4] ..... C08K 3/22

[52] U.S. Cl. ..... 523/139; 106/300; 523/142; 523/143; 523/144; 523/145; 523/146; 523/147; 523/148

[58] Field of Search ..... 106/300; 523/139, 140, 523/141, 142, 143, 144, 145, 146, 147, 148

[56] References Cited

U.S. PATENT DOCUMENTS

| | | | |
|---|---|---|---|
| 3,002,948 | 10/1961 | Lawther et al. | 523/145 |
| 3,385,718 | 5/1968 | Hafford et al. | 106/300 |
| 3,681,101 | 8/1972 | Griffin et al. | 106/300 |
| 3,929,501 | 12/1975 | Dunn | 106/300 |
| 3,964,899 | 6/1976 | Jones et al. | 75/58 |
| 4,222,789 | 9/1980 | Jacobson | 106/300 |
| 4,343,345 | 8/1982 | Brugger | 106/38.27 |
| 4,416,699 | 11/1983 | Jacobson | 106/300 |

*Primary Examiner*—Lewis T. Jacobs

*Attorney, Agent, or Firm*—Andrus, Sceales, Starke & Sawall

[57] ABSTRACT

An additive to foundry sand molding and core aggregates used to produce cores and molds which improves the quality of castings by reducing thermal expansion and gas defects. The additive comprises a composition containing from about 15% to about 95% titanium dioxide ($TiO_2$). Preferably, the composition of the additive comprises about 2–38% silicon dioxide ($SiO_2$), about 5–40% ferric oxide ($Fe_2O_3$), about 15–95% titanium dioxide ($TiO_2$), and about 2–45% aluminum oxide ($Al_2O_3$).

6 Claims, No Drawings

ADDITIVE FOR SAND BASED MOLDING AGGREGATES

BACKGROUND OF THE INVENTION

The present invention relates to additives to foundry sand molding aggregates used in the manufacture of molds and cores, and more particularly an additive containing a high percentage of titanium dioxide ($TiO_2$) which improves the quality of castings by reducing veining and gas defects.

Iron oxides have been used for years in foundry applications to improve core properties and the quality of castings. Iron oxides have proven to be advantageous as an additive to foundry sand molding aggregates, which in turn improves the quality of castings, by reducing the formation of thermal expansion defects, such as veining, scabs, buckles, and rat tails as well as gas defects, such as pinholes and metal penetration.

There are several iron oxides which are currently used in foundries today. These include red iron oxide, also known as hematite ($Fe_2O_3$), black iron oxide, also known as magnetite ($Fe_3O_4$) and yellow ochre. Another iron oxide which is presently being used is Sierra Leone concentrate which is a hematite ore black in color. Red iron oxide and black iron oxide are the most popular iron oxides in use. Red iron oxide typically includes 60–87% $Fe_2O_3$, 7.5–8.5% silica dioxide ($SiO_2$), 2–9.5% alumina dioxide ($AlO_2$), 0.1–11% calcium oxide (CaO), 0.2–2.6% magnesium oxide (MgO) and 0.2–0.4% manganese oxide (MnO). Black iron oxide includes 60–64% $Fe_3O_4$, 1–2% $SiO_2$, 3–4% $AlO_2$, 0.1–0.2% $CaO_2$, 0.8–1% MgO, 0.05–0.1% MnO. Also black iron oxide may contain about 4–6% titanium dioxide. Yellow ochre includes 50–60% $Fe_2O_3$, 19–21% $SiO_2$, 5–7% $AlO_2$ and 0.5–0.7% CaO. Sierra Leone concentrate ore typically includes 92.5% $Fe_2O_3$, 4.75% $SiO_2$, 1% $Al_2O_3$, 0.16% CaO, and 0.73% MnO.

The currently accepted method of employing the above iron oxides is to add approximately 1–3% by weight to the sand mold aggregates during mixing. The exact mechanism by which iron oxides improve surface finish in not totally understood. However, it is generally believed that the iron oxides increase the hot plasticity of the mixture by the formation of a glassy layer between the grains which deforms and "gives", without fracturing at metallurgical temperatures, to prevent fissures from opening up in the sand, which in turn reduces veining.

It should be noted that additives containing high titanium dioxide compositions have not been intentionally added to foundry molding aggregates. Although black iron oxide may contain about 4–6% titanium dioxide, the amount of titanium dioxide in the sand molding aggregate is extremely small. As seen from above, the amount of titanium dioxide typically added to the sand molding aggregate is only about 0.0003% to about 0.0009% by weight of the entire aggregate mixture. Currently, titanium dioxide is used in the manufacture of pigment in the paint industry or as a source of titanium metal itself. The use of high titanium dioxide containing materials as an additive to foundry aggregates thus is a unique application of this mineral.

U.S. Patents to Aignesberger et al U.S. Pat. No. 3,661,829, Dittrich et al U.S. Pat. No. 4,211,567 and Brugger U.S. Pat. No. 4,343,345 are of limited interest in this regard since each refers to the use of an oxide of titanium in sand molding processing. Also, Klaudinyi et al U.S. Pat. No. 3,793,284 refers the use of fire clay or ball clays as an additive to foundry core pastes. However, none of the above references refer to or discuss the advantageous effects of an additive composed of a high percentage of titanium dioxide ($TiO_2$).

SUMMARY OF THE INVENTION

The present invention relates to a composition for use as an additive to foundry sand molding aggregates, which contains a relatively high amount of titanium dioxide ($TiO_2$).

In one aspect, the invention relates to the composition of the additive itself. The additive is mixed with foundry sand molding and core aggregates used in the production of cores and molds to improve the quality of castings by reducing thermal expansion and gas defects. The additive comprises a composition containing from about 15% to about 95% titanim dioxide ($TiO_2$) with a preferred range being 25% to 70% and about 50–55% being most preferred. The composition may further include a metal oxide selected from the group consisting of an iron oxide, such as hematite known as red iron oxide ($Fe_2O_3$) or magnetite known as black iron oxide ($Fe_3O_4$), silica dioxide ($SiO_2$) and aluminum oxide ($Al_2O_3$). Preferably, the metal oxide is red iron oxide or ferric oxide. Preferably, the composition comprises about 2–38% silica dioxide ($SiO_2$), about 5–40% ferric oxide ($Fe_2O_3$), about 15–95% titanium dioxide ($TiO_2$), and about 2–45% aluminum oxide ($Al_2O_3$).

In another aspect, the invention relates to a foundry molding and core mixture used to produce cores and molds comprising about 80% to about 98% of commonly used molding and core sand aggregates selected from the group consisting of silica sand, zircon sand, olivine sand, chromite sand, lake sand, bank sand, fused silica, and mixtures thereof and about 0.5 to about 10.0% of a binder, and about 0.5% to about 5.0% of an additive composition containing from about 15% to about 95% titanium dioxide ($TiO_2$).

The addition to foundry molding and core aggregates of a composition rich in titanium dioxide significantly reduces the casting defects associated with the use of plastic bonded and other binder systems in molding and core sand aggregates, and increases the strength of the resulting bonded aggregates. The use of a high titanium dioxide composition with casting mold and core aggregates allows the reduction of the amount of plastic binder required. This reduction results in lower cost mold and core production, while improving the resulting casting quality.

DESCRIPTION OF THE PREFERRED EMBODIMENT

A composition containing a relatively high amount of titanium dioxide ($TiO_2$) is particularly suited as an additive to foundry sand aggregates used in the manufacture of molds and cores. The additive produces a foundry molding and core aggregate which resists the formation of some of the defects commonly associated with the production of castings produced by sand based molding and core aggregates.

The additive of the present invention may be utilized with foundry sand molding and core aggregates used in the manufacture of molds and cores. Such molds and cores are usually made from mixtures containing silica sand, zircon sand, olivine sand, chromite sand, lake sand, bank sand, fused silica, and mixtures thereof with the sand grains being bound together with a resin which is cured or polymerized by heating in an oven or by chemical catalysis such as gasing. Typically, the mold or core mixture may compose between about 80% to about 98% of the foundry mold and core aggregate, while the binder may compose about 0.5% to about 10% of the mixture. The additive of the present invention may be utilized with numerous conventional core and mold binder systems such as phenolic hot box, phenolic urethane, furan, sodium silicate including ester and carbon dioxide systems, polyester binders, acrylic binders, epoxy binders, and furan warm box systems. Each of the above binder systems is well known in the art and therefore a detailed description thereof is unnecessary.

The additive of the present invention comprises a composition containing from about 15% to about 95% titanium dioxide ($TiO_2$) with a preferred range being 25–70% and about 50–55% being most preferred. With less than about 15% $TiO_2$, the additive becomes less effective resulting in a significant increase in veining, and metal penetration. With more than about 95% $TiO_2$, no signficant increase in effectiveness is anticipated. The additive may further include a metal oxide selected from the group consisting of an iron oxide such as hematite or red iron oxide ($Fe_2O_3$) or magnetite known as black iron oxide ($Fe_3O_4$), silica dioxide ($SiO_2$) and aluminum oxide ($Al_2O_3$). Preferably, the metal oxide is red iron oxide, namely, ferric oxide ($Fe_2O_3$). The preferred composition of the additive includes about 2–38% silica dioxide ($SiO_2$), about 5–40% ferric oxide ($Fe_2O_3$), about 15–95% titanium dioxide ($TiO_2$), and about 2–45% aluminum oxide ($Al_2O_3$). The additive is mixed with the foundry sand aggregate, and binder system, in an amount of between about 0.5% to about 5% by weight, and preferably between 1 to 3% by weight.

The test results of several experimental trials of the use of the additive, herein called "Veinseal", as well as other known additives, added to phenolic resin bonded sand molding and core aggregates are given in Table I.

TABLE I

The Amount of Material was Held Constant at 1.5% by Weight for all the Tests

| Additive Composition | Sand Tensile Strength (psi) | Sand Scratch Hardness |
|---|---|---|
| **At Gasing Time** | | |
| 100% Macor (Commercial Product available from J. McCormick Co. of Pittsburgh, Penn. composed primarily of dextrose and clay) | 82 | 53 |
| 80% $Fe_3O_4$ - 20% Bentonite Clay | 127 | 65 |
| 100% Veinseal (55% $TiO_2$) | 130 | 66 |
| 95% Veinseal (55% $TiO_2$) 5% Pumice Flour | 168 | 71 |
| **24 Hours after Gasing** | | |
| Additive Composition | Sand Tensile Strength | Sand Scratch Hardness |
| 100% Macor | 98 | 68 |
| 80% $Fe_3O_4$ - 20% Bentonite clay | 170 | 80 |
| 100% Veinseal (55% $TiO_2$) | 203 | 86 |
| 95% Veinseal (55% $TiO_2$) 5% Pumice Flour | 215 | 85 |
| **Casting Results** | | |
| Additive Composition | | |

TABLE I-continued

The Amount of Material was Held Constant at 1.5% by Weight for all the Tests

| | |
|---|---|
| 100% Macor | Veining |
| 80% $Fe_3O_4$ - 20% Bentonite clay | Veining |
| 100% Veinseal (55% $TiO_2$) | Clean |
| 95% Veinseal (55% $TiO_2$) 5% Pumice Flour | Moderate Veining |

The testing procedures for preparing and determining the sand tensile strength and sand scratch hardness are the standard tests typically performed in the industry. The test procedures can be found in "AFS Mold and Core Test Handbook", Sections 15 and 16, pp. 15-1 to 15-4 and 16-9 to 16-10.

Note that the use of the "Veinseal" additive of the present invention increases the tensile strength and hardness of sand aggregates bonded with phenolic urethane resins. This effect is evident both immediately after gasing or catalyzing and is also evident 24 hours after gasing or catalyzing. For the results above, it is believed that this effect is due to some extent to the size distribution of this material. The additive is a sand like material with the majority of the particles larger than 320 mesh on a standard Taylor Seive Series. In comparison, most other $Fe_2O_3$ or $Fe_3O_4$ materials used for the purpose of reducing associated sand defects are much finer particles usually less than 320 mesh. Thus, the improvement in strength of the phenolic urethane bonded sand could be attributed to this size difference and the resulting large difference in surface area caused by the larger particle size. The smaller the particle size, the greater the surface area and since the bonding agent must coat this material as well as the remaining sand aggregate, the smaller particle size, the less bonding agent will be available to produce bonding of the sand mold and core aggregate. The amount of material added was held constant (based on 1.5% by weight of the total sand aggregate) in the test described in Table I. Thus, the particle size of the materials containing the additive produce a lower binder demand to coat these materials.

However, it must also be noted that the inherently larger particle size of the additive will result in a less homogeneous distribution throughout the molding aggregate of $TiO_2$ rich areas. Furthermore, the density of $TiO_2$ is higher than that of $Fe_2O_3$ or $Fe_3O_4$, although equal weights of the additive were added to the sand aggregates shown in Table I. Due to this density difference, the total volume of the additive is in fact less than that for the conventional $Fe_2O_3$ or $Fe_3O_4$ competitive additives. Thus, this fact further demonstrates the significant improvement attainable through the use of a $TiO_2$ rich additive in accordance with the present invention.

It should also be apparent from Table I that the casting results of castings made with cores and molds using high $TiO_2$ content additive showed an improved resistance to veining. Since, as stated above, the particle size of the additive is larger than the $Fe_2O_3$ or $Fe_3O_4$ materials, it is of interest that this leads to a less homogeneous distribution of the additive material in the sand aggregate, yet the casting results show a significant improvement. Thus, the improved effectiveness of the high $TiO_2$ additive is even further demonstrated.

The tests shown in Table I used a phenolic urethane resin as the binder. It has been suggested that titanium (Ti) enhances the performance of the phenolic urethane resin. This also explains some of the improved results noted when this type of binder system is employed. However, test results in other plastic binders also indicate an improved effect in the presence of $TiO_2$ rich additives.

TABLE II

Results of the Use of Other $TiO_2$ Rich Materials to Sand Mold Aggregates

| Additive Composition | At Gasing Time Sand Tensile Strength (psi) | 30 Minutes After Gasing Tensile Strength (psi) |
|---|---|---|
| 90% $Fe_2O_3$ | 115 | 163 |
| 100% Veinseal (55% $TiO_2$) | 130 | 183 |
| 100% Veinseal (95% $TiO_2$) | 123 | 235 |

TABLE III

Casting Results

| Additive Composition | Average No. of Veins | Penetration | Height of Veins (in.) |
|---|---|---|---|
| 90% $Fe_2O_3$ | 15 | extensive | 0.100 |
| 100% Veinseal (95% $TiO_2$) | 6 | none | 0.060 |

Table II demonstrates the marked improvement or increasing $TiO_2$ contents as an additive to mold and core sand aggregates. It is important to note that the size distribution of both Veinseal with 55% $TiO_2$ and 95% $TiO_2$ are similar and thus the added improvement caused by the increased $TiO_2$ content in the Veinseal with 95% $TiO_2$ must be due to the increase in $TiO_2$ rather than a size distribution effect as discussed previously. It should also be noted that the trials using 90% $Fe_2O_3$ also confirm this fact since this material is similar in size distribution to that of the Veinseal. This would thus indicate that despite the size distribution effect discussed earlier, a true improvement can be attributed to the mere presence of the high $TiO_2$ content materials.

Note in Table III that the results discussed previously indicating improved mold and core sand properties are borne out in the actual production of castings from these materials. This is evident in both the number of defects observed as well as their severity.

Trials have also been run using non-phenolic sand binder systems with significant success. This demonstrates that additives of $TiO_2$ rich materials to casting mold or core sand aggregates on its own improves the casting properties of these materials. This fact indicates that the improvements noted herein are not merely a function of a possible effect of the high titanium levels on the polymerization of phenolics. This is particularly important since improvements have been seen in the use of a non-plastic binder system based on sodium silicate as the binder. Thus, $TiO_2$ can significantly improve the quality of resulting castings when added to such mold or core sand aggregates. With the reduction of the need for binders in the plastic bonding systems, this invention will result in an improved casting surface finish and if the amount of the binder can also be reduced (possible in many cases due to the improved strengths of the resulting materials), the invention can also lower production costs.

The following tests were also conducted utilizing the Veinseal additive with phenolic urethane/polyisocyanate binder in different combinations. A comparison of test #1 with test #5 clearly shows the improved performance of the additive versus no additive. As shown, there is about a 20% increase in the tensile strengths indicating a clear enhancement of the resin performance.

| | | | | | |
|---|---|---|---|---|---|
| TEST No. 1<br>2% Addition of Veinseal (55% $TiO_2$),<br>1.5% Addition of Binder, 60/40 Split | | | | | |
| Tensile Strength | | | | | |
| @ 1 HR. P.S.I. | 171# | 181# | 175# | 158# | Aver. 171# |
| @ 24 HRS. P.S.I. | 193# | 211# | 234# | 217# | Aver. 214# |
| TEST No. 1A<br>3/4% Addition of Veinseal (55% $TiO_2$),<br>1.5% Addition of Binder, 60/40 Split | | | | | |
| Tensile Strength | | | | | |
| @ 1 HR. P.S.I. | 156# | 168# | 180# | 190# | Aver. 174# |
| @ 24 HRS. P.S.I. | 230# | 228# | 223# | 240# | Aver. 230# |
| TEST No. 2<br>2% Additional of Veinseal (55% $TiO_2$),<br>1.5% Addition of Binder, 50/50 Split | | | | | |
| Tensile Strength | | | | | |
| @ 1 HR. P.S.I. | 269# | 238# | 275# | 257# | Aver. 260# |
| @ 24 HRS. P.S.I. | 298# | 306# | 303# | 288# | Aver. 299# |
| TEST No. 2A<br>3/4% Addition of Veinseal (55% $TiO_2$),<br>1.5% Addition of Binder, 50/50 Split | | | | | |
| Tensile Strength | | | | | |
| @ 1 HR. P.S.I. | 283# | 276# | 294# | 275# | Aver. 282# |
| @ 24 HRS. P.S.I. | 307# | 278# | 315# | 313# | Aver. 303# |
| TEST No. 3<br>2% Addition of Veinseal (55% $TiO_2$),<br>1.5% Addition of Binder, 55/45 Split | | | | | |
| Tensile Strength | | | | | |
| @ 1 HR. P.S.I. | 221# | 250# | 237# | 225# | Aver. 233# |
| @ 24 HRS. P.S.I. | 241# | 277# | 256# | 261# | Aver. 259# |
| TEST No. 3A<br>3/4% Addition of Veinseal (55% $TiO_2$),<br>1.5% Addition of Binder, 55/45 split | | | | | |
| @ 1 HR. P.S.I. | 226# | 238# | 210# | 237# | Aver. 228# |
| @ 24 HRS. P.S.I. | 278# | 268# | 235# | 287# | Aver. 267# |
| TEST No. 4<br>2% Addition of Veinseal (55% $TiO_2$)<br>1% Addition of Binder, 50/50 Split | | | | | |
| @ 1 HR. P.S.I. | 175# | 168# | 170# | 171# | Aver. 171# |
| @ 24 HRS. P.S.I. | 227# | 225# | 232# | 211# | Aver. 224# |
| TEST No. 5<br>1.5% Addition of Binder, 60/40 Split<br>Without Veinseal | | | | | |
| @ 1 HR. P.S.I. | 128# | 160# | 139# | 138# | Aver. 141# |
| @ 24 HRS. P.S.I. | 176# | 184# | 162# | 167# | Aver. 172# |

The results presented here demonstrate the significant benefits to be attained through the use of $TiO_2$ rich materials added to molding and core aggregates used in casting manufacture. Such additions reduce significantly the casting defects associated with the use of plastic bonded and other binder systems in molding sand aggregates and increase the strength of the resulting bonded aggregates. The use of high $TiO_2$ content materials to casting mold and core aggregates allows the reduction of the amount of plastic binder required. This reduction results in lower cost mold and core production, while improving the resulting casting quality.

Various modes of carrying out the invention are contemplated as being within the scope of the appended claims, particularly pointing out and distinctly claiming the subject matter which is regarded as the invention.

I claim:

1. An additive to foundry sand molding and core aggregates used to produce cores and molds which improves the quality of castings by reducing thermal expansion and gas defects comprising a composition consisting essentially of, by weight, from about 15% to about 95% titanium dioxide ($TiO_2$), and said composition further includes about 5% to about 40% of an iron oxide, and said iron oxide is ferric oxide ($Fe_2O_3$).

2. An additive to foundry sand molding and core aggregates used to produce cores and molds which improves the quality of castings by reducing thermal expansion and gas defects comprising a composition containing from about 2–38% silica dioxide ($SiO_2$), about 5–10% ferric oxide ($Fe_2O_3$), about 15–95% titanium dioxide ($TiO_2$), and about 2–45% aluminum oxide ($Al_2O_3$).

3. A foundry molding and core mixture used to produce cores and molds comprising about 80% to 98% sand aggregates selected from the group consisting of silica sand, zircon sand, olivine sand, chromite sand, lake sand, bank sand, fused silica and mixtures thereof, about 0.5% to about 10.0% of a binder, and about 0.5% to about 5.0% of an additive composition containing from about 15% to about 95% titanium dioxide ($TiO_2$).

4. The mixture of claim 3 wherein said composition further includes a metal oxide selected from the group consisting of an iron oxide, silica dioxide ($SiO_2$), and aluminum oxide ($Al_2O_3$).

5. The mixture of claim 3 wherein said composition further includes ferric oxide ($Fe_2O_3$).

6. The mixture of claim 3 wherein said composition comprises about 2–38% silica dioxide ($SiO_2$), about 5–10% ferric oxide ($Fe_2O_3$), about 15–95% titanium dioxide ($TiO_2$), and about 2–45% aluminum oxide ($Al_2O_3$).

* * * * *